US007792680B2

(12) United States Patent
Iser et al.

(10) Patent No.: US 7,792,680 B2
(45) Date of Patent: Sep. 7, 2010

(54) METHOD FOR EXTENDING THE SPECTRAL BANDWIDTH OF A SPEECH SIGNAL

(75) Inventors: Bernd Iser, Ulm (DE); Gerhard Uwe Schmidt, Ulm (DE)

(73) Assignee: Nuance Communications, Inc., Burlington, MA (US)

( * ) Notice: Subject to any disclaimer, the term of this patent is extended or adjusted under 35 U.S.C. 154(b) by 736 days.

(21) Appl. No.: 11/544,470

(22) Filed: Oct. 6, 2006

(65) Prior Publication Data

US 2007/0124140 A1 May 31, 2007

(30) Foreign Application Priority Data

Oct. 7, 2005 (EP) ..... 05021934

(51) Int. Cl.
*G10L 19/12* (2006.01)

(52) U.S. Cl. ..... 704/500; 704/223; 704/226

(58) Field of Classification Search ..... 704/223, 704/226, 500
See application file for complete search history.

(56) References Cited

U.S. PATENT DOCUMENTS 5,455,888 A * 10/1995 Iyengar et al. ..... 704/203
6,832,188 B2 * 12/2004 Accardi et al. ..... 704/223
7,359,854 B2 * 4/2008 Nilsson et al. ..... 704/219
2003/0050786 A1 3/2003 Jax et al. ..... 704/500
2003/0093279 A1 * 5/2003 Malah et al. ..... 704/265
2005/0065792 A1 * 3/2005 Gao ..... 704/233

OTHER PUBLICATIONS

European Association for Signal, Speech, and Image Processing; EURASIP News Letter; Jun. 2005; vol. 16, No. 2.
J. Epps and W. H. Holmes; A New Technique for Wideband Enhancement of Coded Narrowband Speech; Jun. 1999; pp. 174-176.
Peter Jax; Dissertation Abstract; Enhancement of Bandlimited Speech Signals: Algorithms and Theoretical Bounds; Nov. 2002; 1 page.
Ulrich Kornagel; Spectral Widening of the Excitation Signal for Telephone-Band Speech Enhancement; Sep. 2001; pp. 215-218.
Jean-Marc Valin and Roch Lefebure; Bandwidth Extension of Narrowband Speech for Low Bit-Rate Wideband Coding; Sep. 2000; pp. 130-132.

* cited by examiner

*Primary Examiner*—Talivaldis Ivars Smits
*Assistant Examiner*—Shaun Roberts
(74) *Attorney, Agent, or Firm*—Sunstein Kann Murphy & Timbers, LLP

(57) ABSTRACT

A method for extending the spectral bandwidth of an excitation signal of a speech signal includes determining a bandwidth limited excitation signal of the speech signal, and applying a nonlinear function to the excitation signal for generating a bandwidth extended excitation signal.

20 Claims, 10 Drawing Sheets

METHOD FOR EXTENDING THE SPECTRAL BANDWIDTH OF A SPEECH SIGNAL

RELATED APPLICATIONS

This application claims priority of European Application Serial Number 05 021 934.4, filed on Oct. 7, 2005, titled METHOD FOR EXTENDING THE SPECTRUAL BANDWIDTH OF A SPEECH SIGNAL; which is incorporated by reference in this application in its entirety.

BACKGROUND OF THE INVENTION

1. Field of the Invention

The invention relates to methods for extending the spectral bandwidth of an excitation signal of a speech signal, methods for reconstructing noisy parts of a speech signal recorded in a noisy environment, and methods for enhancing the quality of a speech signal.

2. Related Art

Speech is the most natural and convenient way of human communication. This is one reason for the great success of the telephone system since its invention in the $19^{th}$ century. Today, subscribers are not always satisfied with the quality of the service provided by the telephone system, especially when compared to other audio sources, such as radio, compact disk or DVD. The degradation of speech quality using analog telephone systems is often caused by the introduction of band limiting filters within amplifiers employed to keep a certain signal level in long local loops. These filters typically have a passband from approximately 300 Hz up to 3400 Hz and are applied to reduce crosstalk between different channels. However, the application of such bandpass filters considerably attenuates different frequency parts of the human speech ranging from about 0 Hz up to 6000 Hz.

Great efforts have been made to increase the quality of telephone speech signals in recent years. One possibility to increase the quality of a telephone speech signal is to increase the bandwidth after transmission by means of bandwidth extension. The basic idea of these enhancements is to establish the speech signal components above 3400 Hz and below 300 Hz and to complement the signal in the idle frequency bands with this estimate. In this case the telephone networks can remain untouched.

Additionally, mobile communication systems such as cellular phones have been developed in recent years and are employed in different environments. By way of example, cellular phones are often employed in vehicles or in other environments where a strong background noise exists. In vehicle applications, a hands-free speaking system is often employed to avoid diverting the attention of the driver from the traffic while using the cellular phone.

Additionally, speech recognition systems have been developed that are also often employed inside vehicles. These systems are able to control different functions of the vehicle. In these systems, the speech recognition system needs to recognize the commands and other audio inputs of the driver, the recorded signal comprising speech components and noise components. The same is true for hands-free systems, in which the recorded speech signal from the driver also includes noise components from the background noise inside the vehicles.

In both systems, when a telephone call is received via a telecommunication system having a limited bandwidth or when speech is recorded in a noisy environment, there exists the problem that certain frequency ranges are either not present in the transmitted signal or are heavily distorted. On the other hand, a speech signal having an extended frequency range could be better understood. Accordingly, the speech quality in the above-mentioned scenarios (e.g., in very high noise conditions) where traditional methods such as noise suppression systems do not work properly needs to be improved. Therefore, a need exists to provide a method for restoring a signal for which a certain frequency part is missing.

SUMMARY

According to one implementation, a method for extending the spectral bandwidth of an excitation signal of a speech signal is provided. The method may include determining a bandwidth limited excitation signal of the speech signal. Once the bandwidth limited excitation signal is determined, a nonlinear function is applied to the excitation signal for generating a bandwidth extended excitation signal.

According to another implementation, the nonlinear function is a quadratic function according to the following formula:

$$\tilde{x}_{Anr,i}(n)=c_2(n)x^2_{p,i}(n)+c_1(n)x_{p,i}(n)$$

The coefficients $c_1$ and $c_2$ of above-mentioned applications, which coefficients are dependent on time n, may be determined in such a way that:

$$c_1(n) = K_1 - x_{max}(n)c_2(n) = K_1 - x_{max}\left(\frac{K_1 - K_2}{x_{max}(n) - x_{min}(n) + \varepsilon}\right), \text{ and}$$

$$c_2(n) = \frac{K_1 - K_2}{x_{max}(n) - x_{min}(n) + \varepsilon}.$$

The above parameters will be explained in detail later on.

By choosing the quadratic function as mentioned above and by selecting the coefficients $c_1$ and $c_2$ as described, an extended excitation signal may be obtained for which the adaptive coefficients $c_1$ and $c_2$ allow for adjusting whether the linear term or the quadratic term should be considered more than the other term.

According to another implementation, a bandwidth limited spectral envelope of the speech signal is determined for generating the excitation signal, and removed from the speech signal by applying the inverse spectral envelope to the speech signal. This may be done either in the frequency domain or in the time domain of the signal. In the frequency domain of the signal, the inverse spectral envelope may be multiplied with the speech signal to remove the spectral envelope. In the time domain, this multiplication may correspond to a convolution of the spectral envelopes and of the speech signal. By removing the spectral envelope, the excitation signal may be obtained. The excitation signal itself may be a spectrally flat signal. Before generating a bandwidth extended excitation signal, the narrowband excitation signal may first be determined.

According to another implementation, the speech signal is divided into overlapping segments for carrying out the necessary calculations and for extending the bandwidth of the excitation signal. Each segment of the speech signal may be described by a vector, the vector describing one segment of the speech signal when the spectral envelope of the speech signal has been removed, i.e. when the inverse filter or the predictor error filter has been applied:

$x_p(n)=[x_{p,0}(n), x_{p,1}(n), \ldots, x_{p,N-1}(n)]^T$, $N$ being the length of the input vector.

According to another implementation, the parameters $x_{max}$ and $x_{min}$ mentioned above, describing the maximum or the minimum of the input vector $x_p$, may be defined as follows:

$$x_{max}(n)=\max\{x_{p,0}(n), x_{p,1}(n), \ldots x_{p,N-1}(n)\}, \text{ and}$$

$$x_{min}(n)=\min\{x_{p,0}(n), x_{p,1}(n), \ldots, x_{p,N-1}(n)\}.$$

The values $x_{max}(n)$, $x_{min}(n)$ may be employed for determining the coefficients $c_1$, $c_2$ mentioned above.

According to another implementation, the term $\epsilon$ mentioned above may be a small number larger than zero in order to avoid a division through zero. The two constant factors $K_1$ and $-K_2$ determine the maximum and the minimum after applying the quadratic function to the speech signal. The following values have been found as being particularly useful for the above-mentioned excitation signal: $K_1$ may be a value in the range from 0.5 to 1.7. In another example, $K_1$ may be a value in the range from 1.0 to 1.5. In yet another example, $K_1$ is 1.2. $K_2$ may be a value in the range from 0.0 to 0.5. In another example, $K_2$ may be a value in the range from 0.1 to 0.3. In yet another example, $K_2$ is 0.2.

One property of these nonlinear characteristics utilized above for extending the bandwidth of the excitation signal is that these nonlinear characteristics produce strong components around 0 Hz, which need to be removed. Accordingly, the extended excitation signal may be highpass filtered for removing the frequency components around 0 Hz.

According to another implementation, before the extended excitation signal is calculated, the bandwidth limited spectral envelope of the bandwidth limited speech signal is determined. This limited spectral envelope may, for example, be determined using a linear predictive coding (LPC) analysis. With about ten coefficients of the linear predictive coding analysis, it is possible to estimate the spectral envelope of a speech signal in a reliable manner.

According to another implementation, the extended parts of the excitation signal are utilized for replacing noisy parts of the bandwidth limited excitation signal, the bandwidth limited excitation signal corresponding to the speech signal recorded in a noisy environment for which the frequency components in which the noise is a dominant factor have been suppressed.

Furthermore, the extended parts of the excitation signal may also be used for replacing the corresponding parts of a bandwidth limited excitation signal corresponding to a bandwidth limited speech signal transmitted via a transmission unit of a telecommunication system, the spectral parts of the speech signal suppressed by the transmission line being generated on the basis of the extended spectral bandwidth parts of the excitation signal. As mentioned in the introductory part of the specification, not all frequency components are transmitted in an analog telephone system. According to an aspect of the invention, the spectral parts suppressed by the transmission system may be generated utilizing the extended excitation signal as mentioned above.

The basic idea of bandwidth extension in order to extract information on missing components from the available narrowband signal may be utilized in another implementation relating to a method for reconstructing noisy parts of a speech signal recorded in a noisy environment.

According to another implementation, a method is provided for reconstructing noisy parts of a speech signal recorded in a noisy environment. The method may include determining the noisy parts of the speech signal in which the noise components of the recorded signal dominate the speech components of the speech signal. By way of example, the noisy parts may be the parts of the speech signal in which the signal to noise ratio is about 0 dB. In these very high noise conditions, traditional methods such as noise suppression systems do not work properly. The method may further include determining a bandwidth limited spectral envelope of the speech signal. Furthermore, on the basis of the speech signal, a bandwidth limited excitation signal may be determined, the noisy parts of the speech signal being suppressed when the excitation signal is determined. Additionally, a bandwidth extended excitation signal may be generated by applying a nonlinear function to the excitation signal. Additionally, noisy parts of the speech signal, in which the noise is the dominant factor, may be replaced on the basis of the extended parts of the bandwidth extended excitation signal for generating an enhanced speech signal.

Especially in hands-free systems or in speech recognition systems employed in vehicles, the recorded speech signal often includes a large noise component originating from the vehicle itself or from the wind when the vehicle is moving. For improving the recognition rate of the speech recognition system or for improving the speech quality, noise reduction schemes are employed in prior art systems. These schemes may help to improve the signal to noise ratio and therefore to improve the speech quality. However, when the speech data are largely deteriorated by the noise, the noise reduction methods of the prior art deteriorate the quality of the signal recorded by the microphone.

According to an aspect of the invention, the noisy parts of the speech signal are replaced by an extrapolated signal.

According to an implementation, the noisy parts of the speech signal are determined by first determining the parts of the recorded speech signal comprising speech components. For the part of the speech signal that includes speech components, the part of the signal is determined in which the noise components are so dominant or powerful that noise suppression methods do not work.

According to an implementation, the bandwidth limited envelope of the recorded speech signal is determined using a linear predictive coding analysis. It will be understood, however, that any other suitable method may be employed for determining the envelope of the speech signal according to other implementations of the invention.

According to another implementation, once the bandwidth limited envelope of the speech signal is determined, the bandwidth extended envelope may be determined. In one example, the bandwidth extended envelope may be determined by comparing the bandwidth limited spectral envelope to predetermined envelopes stored in a lookup table or codebook, and by selecting the envelope of the lookup table that best matches the bandwidth limited spectral envelope speech signal. This approach of determining the extended spectral envelope is also called a codebook approach. A codebook may contain a representative set of band limited and broadband vocal tract transfer functions. Typical codebook sizes range from 32 up to 1024 entries. The spectral bandwidth limited envelope of the current frame may be computed, e.g. in terms of ten predictor coefficients by employing the above-mentioned linear predictive coding analysis, the coefficients being compared to all entries of the codebook. In case of codebook pairs, the band limited entry that is closest according to a distance measure to the current envelope is determined and its broadband counterpart is selected as an extended bandwidth envelope. This extended envelope corresponds to the envelope of the speech signal that would be recorded if the signal were recorded in an environment having less or no background noise.

According to another implementation, the best matching envelope may then be combined with the bandwidth extended excitation signal, resulting in the enhanced bandwidth extended speech signal. The bandwidth extended excitation signal may be multiplied with the best matching envelope in the frequency domain or, alternatively, a convolution of the two signals in the time domain is also possible.

According to another implementation, the parts of the speech signal are not taken into account in which the noise is the dominant factor, when the bandwidth limited excitation signal is determined. This may help to prevent a situation in which very noisy parts of the signal deteriorate the finding of the right envelope. By suppressing these parts, the speech signal for the bandwidth limited excitation signal is determined and the correct envelope may be determined more easily.

According to another implementation, the enhanced speech signal is generated by replacing the noisy parts of the recorded speech signal by the corresponding parts of the extended speech signal while the other parts of the originally recorded speech signal remain unchanged. Even if the signal is not exactly the same as the original one, the speech quality may be increased together with the recognition rate.

According to another implementation, the speech signal is recorded at a sampling frequency higher than 8 kHz. Most of the fricatives have a frequency part that is higher than 3 kHz. If the frequency domain between 3 and 4 kHz is strongly deteriorated by noise components, the estimation of the envelope may become difficult. If, however, signal components in the frequency range larger than 4 kHz can be utilized, the envelope may be determined more easily.

As discussed above, the noisy parts of the speech signal are suppressed before the excitation signal is determined. Accordingly, the bandwidth of the excitation signal needs to be extended to the suppressed frequency ranges that could not be utilized due to the strong noise. According to an implementation, the extended excitation signal is calculated as described in the above-mentioned method for extending the spectral bandwidth of the excitation signal. By multiplying the bandwidth limited excitation signal to the quadratic function, described in more detail elsewhere in the present disclosure, the extended excitation signal may be calculated in a very effective way.

According to another implementation, a method is provided for enhancing the quality of a speech signal. The method may include determining a spectral envelope of the speech signal based on a bandwidth limited speech signal. Furthermore, a bandwidth limited excitation signal is generated from the speech signal. Moreover, the spectral bandwidth of the excitation signal is extended, and the bandwidth extended excitation signal is applied to the envelope for generating the enhanced speech signal.

According to another implementation, the above-mentioned steps may be utilized for extending the spectral bandwidth of the speech signal transmitted by a bandwidth limited transmission system. At the same time, however, the above-mentioned steps may also be utilized for reconstructing noisy parts of a speech signal recorded in a noisy environment.

According to another aspect, a method for a spectral bandwidth extension of a speech signal transmitted by a limited bandwidth transmission system such as a telecommunication system, and a method for reconstruction noisy parts of a speech signal recorded in a noisy environment, include a plurality of steps in common. A joint scheme may be obtained to restore frequency parts of a speech signal. For bandwidth extension of telephone band limited signals, the frequency range that needs to be restored is fixed (e.g. below 300 Hz and above approximately 3.5 kHz). For a signal reconstruction of a speech signal recorded in a noisy environment, the frequency range to be restored is not specified in advance, but depends on the type of noise and on the individual speech frequencies. By means of the joint scheme, the speech quality can be enhanced, especially in those scenarios where traditional methods such as noise suppression systems do not work properly.

According to another implementation, the spectral envelope is removed from the bandwidth limited speech signal for generating the bandwidth limited excitation signal. The bandwidth limited excitation signal may then be utilized for generating the bandwidth extended excitation signal as described above by multiplying it with the nonlinear function. However, if the bandwidth of the speech signal should be increased, it may also be necessary to increase the sampling frequency at the beginning of the process, i.e. before the spectral envelope is determined. According to one implementation, the part of the frequency domain to be replaced by the bandwidth extension is known in advance. This is the case when the speech signal is the signal transmitted via a transmission unit/line of a telecommunication system, the spectral parts of the speech signal suppressed by the transmission line being added by the spectral bandwidth extension.

According to another implementation, the spectral envelope is determined on the basis of the bandwidth limited speech signal transmitted by the bandwidth limited transmission system, the bandwidth extended envelope being determined by comparing the bandwidth limited spectral envelope to predetermined envelopes stored in the lookup table. The envelope in the lookup table that best matches the bandwidth limited spectral envelope of the voice signal is selected and the extended spectral envelope is applied to the extended excitation signal for generating the enhanced speech signal that has an extended bandwidth.

According to another implementation, the noisy parts of a speech signal recorded in a noisy environment are reconstructed according to a method as mentioned above.

According to another implementation, a system is provided for extending the spectral bandwidth of the speech signal transmitted by a bandwidth limited transmission system and for a signal reconstruction of noisy parts of the speech signal recorded in a noisy environment. According to one aspect, one system may be utilized for both cases, for the receiving part of a telephone and for the transmitting part of a telephone used in a noisy environment. To this end, the system may include a determination unit for determining the spectral envelope of the speech signal based upon a bandwidth limited part of the speech signal. Additionally, a generating unit is provided for generating a bandwidth limited excitation signal. A calculation unit is provided for calculating the bandwidth extended excitation signal and for applying the spectral envelope to the bandwidth extended excitation signal for generating the enhanced speech signal.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
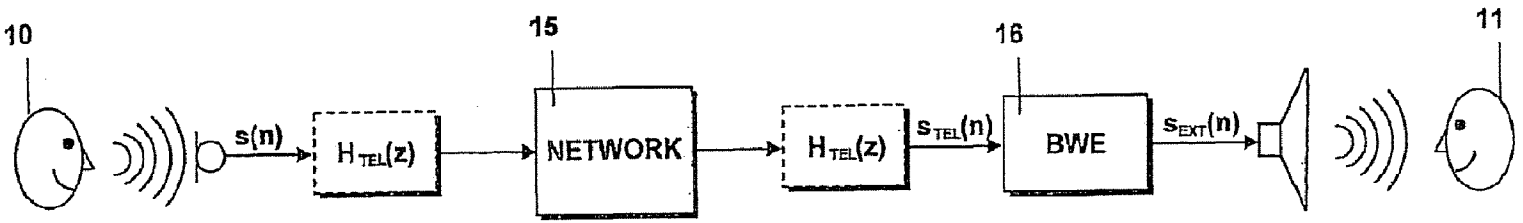
FIG. 1 is a schematic view of an example of a telecommunication system in which bandwidth extension may be utilized according to implementations of the invention.

FIG. 1 is a schematic view of an example of a telecommunications system in which the bandwidth extension according to the invention may be utilized. As shown in FIG. 1, a first subscriber 10 of a telecommunication system communicates with a second subscriber 11 of the telecommunication system. The speech signal s(n) from the first subscriber 10 is transmitted via a network 15. In FIG. 1, the dashed lines (boxes labelled $H_{TEL}(Z)$) indicate the locations where the transmitted speech signal $s_{tel}(n)$ undergoes the band limitations that take place depending on the routing of the call. The degradation of the speech quality using analog telephone systems is often caused by the band limiting filters within amplifiers, these filters having a bandwidth from 300 Hz up to 3400 Hz. One possibility to increase the speech quality for the subscriber 11 receiving the speech signal is to increase the bandwidth after transmission by means of a bandwidth extension unit 16. The resulting bandwidth extended speech signal $s_{ext}(n)$ is then transmitted to subscriber 11. The extended sound signals sound more natural and, as a variety of listening tests indicates, the speech quality in general is increased as well.

Figure 2:
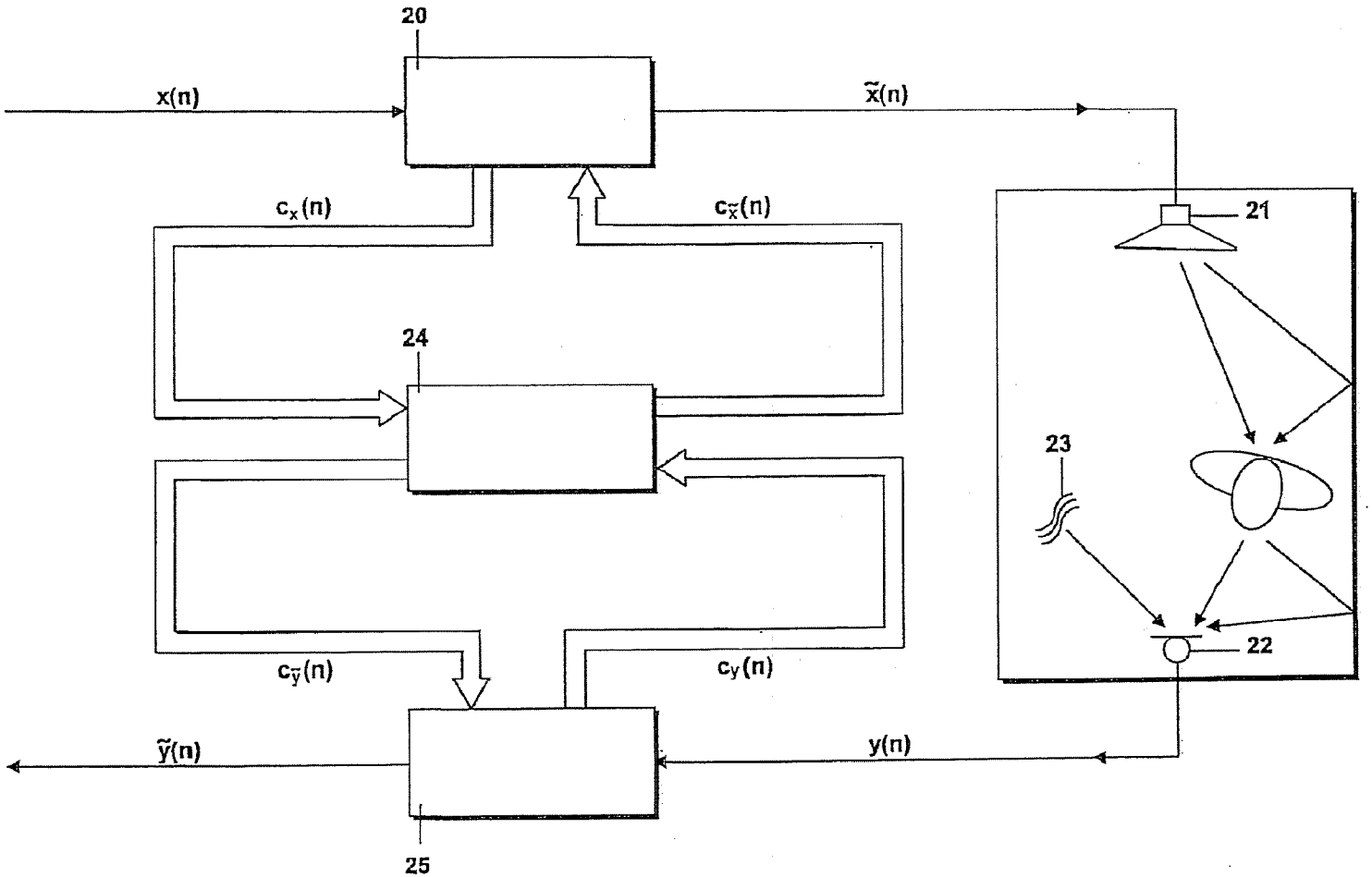
FIG. 2 is a schematic view of an example of a hands-free communication system and/or a speech recognition system utilizing spectral bandwidth extension according to implementations of the invention.

In FIG. 2, an example of a system is shown in which the present invention may be incorporated. The system may be a hands-free speaking system that may be incorporated into a vehicle. However, the system may also be a speech recognition system utilized, by way of example, in vehicles for controlling different functions of the vehicle with the use of speech commands. An incoming speech signal x(n) is shown in the upper part of FIG. 2. In the case of a hands-free speaking system the received signal x(n) is the telephone signal. In the case of a speech recognition system, the signal x(n) is the signal that is to be emitted from the speech recognition system. When the system "talks" to its user the received signal x(n) is input into a bandwidth extension unit 20, which extends the bandwidth of the received signal x(n) before it is emitted via the loudspeaker 21. The bandwidth extended speech signal is designated as $\tilde{x}$ (n) in FIG. 2. In the case of a telecommunication signal, the bandwidth extension unit 20 adds the non-transmitted frequencies in the range from about 0 to 200 Hz and from about 3700 Hz to 6000 Hz. The speech quality of the signal $\tilde{x}$ (n) may improve when the bandwidth of the emitted signal has been extended by up to about 6000 Hz.

In the case of a speech recognition system, the spectral bandwidth extension has different advantages: the coding of the emitted prompts can be done by utilizing simpler coding and decoding methods when the bandwidth extension is done during the emitting process. Additionally, less space is needed for storing the bandwidth limited coded data than for storing the bandwidth extended coded data. The lower part of FIG. 2 shows the transmitting path of the system, i.e., when a telephone signal utilized in a hands-free system is transmitted to the other subscriber, or when the user employs a command for controlling a device with the help of a speech recognition system. A microphone 22 records the voice of the user. Furthermore, the background noise 23 present in the neighborhood of the user is also recorded by the microphone 22. The background noise 23 may be the background noise present in a moving vehicle, or the background noise 23 may be any other noise present in the neighborhood of a user of a hands-free speaking system.

In the prior art, methods are known for reducing the background noise that can be employed up to a certain signal to noise ratio. The system of FIG. 2, however, does not reduce the background noise, but replaces the noisy parts of a signal using a bandwidth extension method.

As will be described in detail later on, both parts of the system, the receiving part and the transmitting part, utilize a common approach, depicted in FIG. 2 by a signal reconstructing unit 24. A speech recognition unit 25, in which noise reduction schemes may also be employed, and the bandwidth extension unit 20 utilize a common approach for reconstructing the missing part of the signal, be it the missing part due to the bandwidth limited transmission system as in the upper part of FIG. 2 or be it the noisy parts of a recorded speech signal as in the lower part of FIG. 2.

Figure 3:
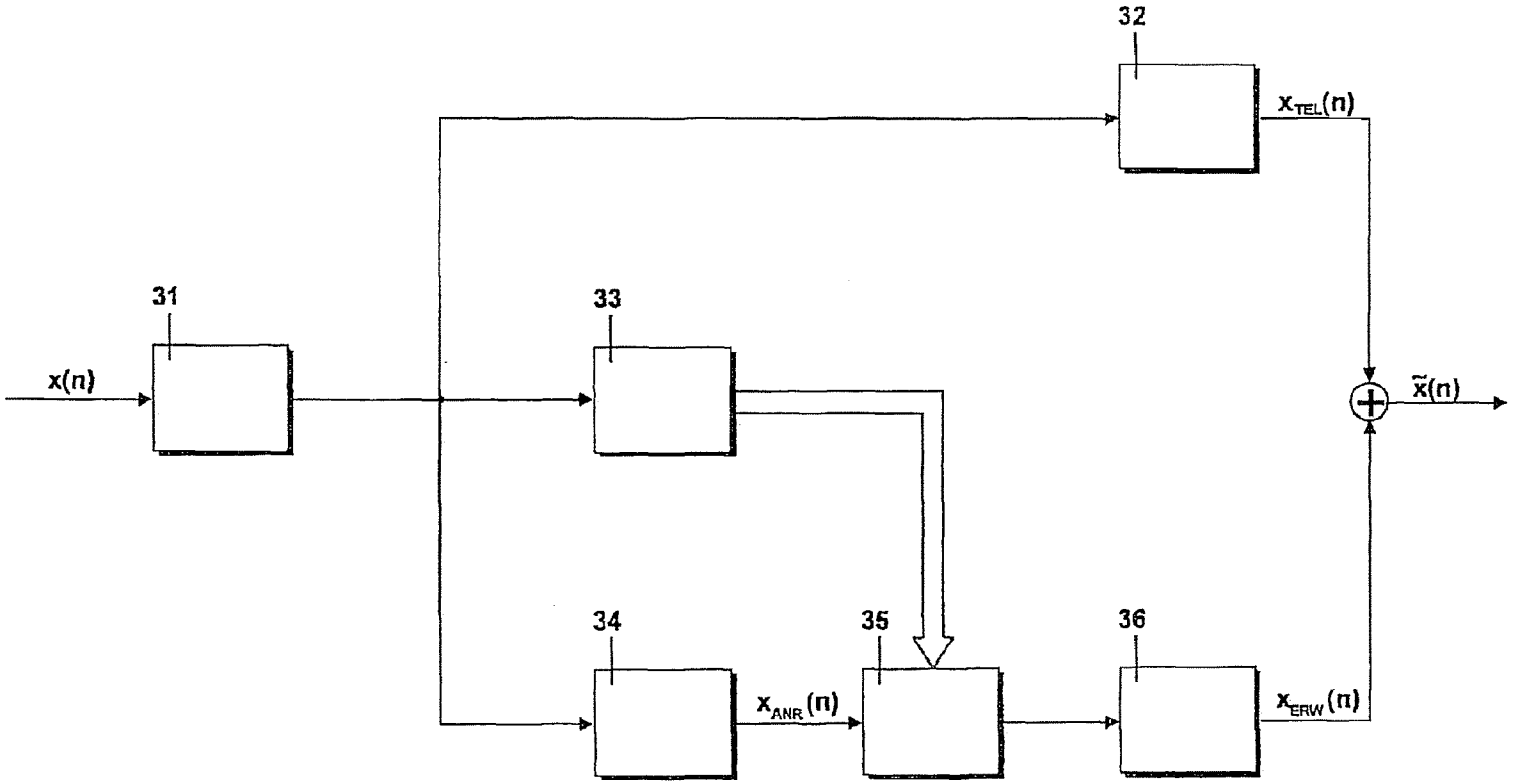
FIG. 3 is a schematic view of an example of a system for extending the bandwidth of a speech signal according to implementations of the invention.
Figure 4:
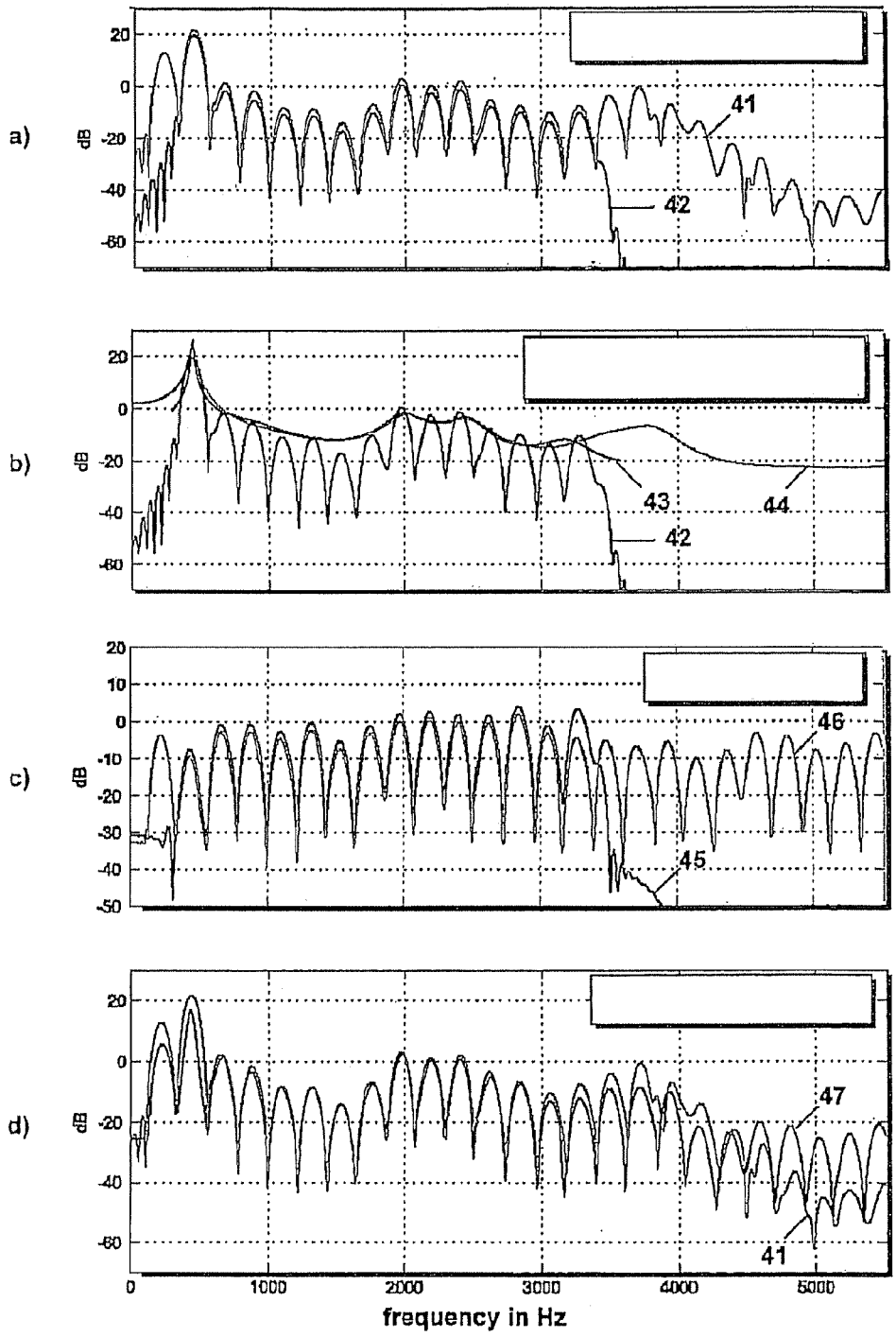
FIG. 4 is a set of graphs illustrating different signals for the bandwidth limited telephone signals and the bandwidth extended signal according to implementations of the invention.

FIG. 3 is a schematic view of an example of a system for extending the bandwidth of a speech signal according to implementations of the invention. FIG. 4 is a set of graphs illustrating different signals for the bandwidth limited telephone signals and the bandwidth extended signal according to implementations of the invention. In connection with FIGS. 3 and 4, the bandwidth extension of a bandwidth limited signal is explained in more detail.

In FIG. 3, the bandwidth limited telephone signal x(n) is input into a converting unit 31 that increases the sampling frequency of the received speech signal x(n). If additional frequencies are to be generated, the sampling frequency needs to be increased in advance. In the converting unit 31, no additional frequency components are generated. In FIG. 4*a*, typical parts of the spectrum of the signals are shown. The spectrum 41 shows the spectrum of a speech signal. When this speech signal 41 is transmitted using a commonly known telecommunication system, the receiving person receives the signal as shown by graph 42. As can be seen by comparing signals 41 to 42, the frequency components below 200 Hz and above around 3500 Hz attenuated by the transmission system. The received signal 42 should be transformed in a frequency expanded signal after the transmission again. To this end, as can be seen in FIG. 4*b*, a bandwidth limited spectral envelope 43 of the bandwidth limited speech signal 42 is determined. The bandwidth limited envelope 43 may be determined, for example, by utilizing a linear predictive coding (LPC) analysis. Additionally, it is known to employ neuronal networks for this purpose.

When the linear predictive coding analysis is utilized, it is possible to estimate the spectral envelope of a speech signal in a reliable manner when about ten (10) coefficients of the LPC analysis are known. Once the bandwidth limited spectral envelope 43 is determined, the broadband envelope 44 can be calculated. This may be done by comparing the determined bandwidth limited envelope 43 to a predetermined envelope stored in a lookup table or codebook, and by selecting the envelope of the lookup table that best matches the bandwith limited spectral envelope of the speech signal. The codebook or lookup table may include representative sets of broadband and band limited vocal tract transfer functions. When the spectral envelope of the current frame of the speech signal is computed, e.g. in terms of ten (10) predictor coefficients, the latter are compared to the entries or the codebook. In case of codebook pairs, the band limited entry that is closest according to a distance measured to the current envelope is determined and its broadband counterpart 44 is selected as the estimated broadband spectral envelope. It is also possible that the codebook only comprises broadband envelopes. In this case, the search is directly performed on the broadband entries.

In the next step, the spectral envelope of the speech signal is removed, e.g. by applying the inverse filter (predictor error filter) on the speech signal to obtain the excitation signal itself. This can be done by multiplying the spectrum of the speech signal with the inverse spectral envelope, so that the signal 45 shown in FIG. 4*c* is obtained. The signal 45 is the band limited excitation signal. As mentioned in the introductory part of the description, the excitation signal may come from the so-called source-filter model of speech generation, the excitation signal being the signal observed directly behind the vocal cords. This excitation signal has the property of being spectrally flat as can be seen in FIG. 4*c*. After passing the vocal cords, the flowing air travels through different cavities resulting in a speech signal which is shown by graph 41. Once the bandwidth limited excitation signal 45 is obtained, the bandwidth extended excitation signal 46 needs to be calculated.

The way of broadening the spectra of the excitation signal will be explained in detail later on. Once the spectral envelope in its broadband form is determined, the broadband excitation signal 46 may be multiplied with the extended envelope 44 of FIG. 4*b*. This multiplication in the frequency domain corresponds to a convolution in the time domain. After this step, the signal 47 is obtained as can be seen in FIG. 4*d*. While the calculated signal 47 does not completely correspond to the original speech signal 41, FIG. 4*d* demonstrates that a remarkable improvement of the speech quality may be achieved.

Returning to FIG. 3, the received telephone signal x(n) may be bandpass-filtered by a bandpass filter 32 that transmits the frequencies of around 200 Hz to about 3700 Hz. This corresponds to the received limited signal 42 shown in FIG. 4*a*. To extend the spectral bandwith the signal is transmitted to a broadband envelope determining unit 33, where based on the bandwidth limited envelope the broadband envelope of the signal is determined. Additionally, the excitation signal may be determined in an excitation signal determining unit 34. The excitation signal $x_{ANR}(n)$ may be mixed with the broadband envelope in a signal mixing unit 35. The resulting signal then passes a band delimiting filter 36 that eliminates the frequency components that were passed by the bandpass filter 32, i.e., the filter 36 eliminates the frequency components of around 200 to about 3700 Hz. The extended signal components $x_{ERW}(n)$ may then be combined with the original signal resulting in the enhanced speech signal $\tilde{x}$ (n) as shown in the right part of FIG. 3.

Figure 5:
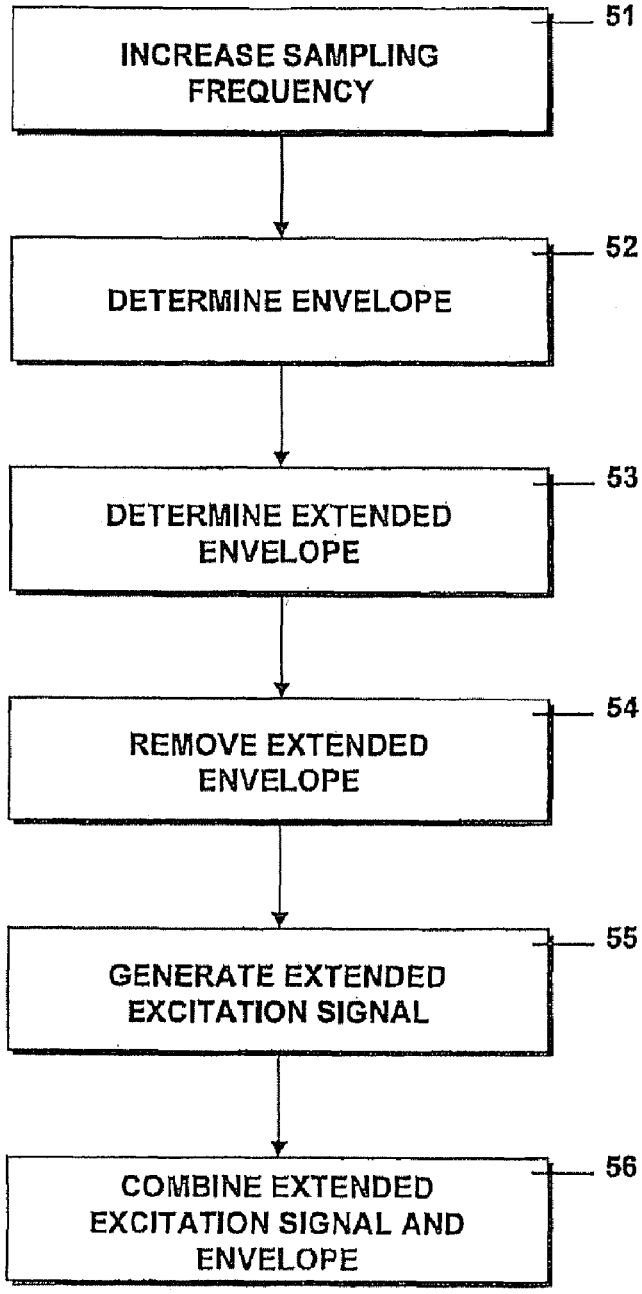
FIG. 5 is a flowchart illustrating an example of a method for carrying out the bandwidth extension shown in FIG. 3.

FIG. 5 is a flow diagram illustrating an example of a method for carrying out the bandwidth extension of a bandwidth limited signal, transmitted for example via a bandwidth limiting transmission system. In step 51, a sampling frequency is increased to a higher frequency. By way of example, in the telephone system the sampling frequency may be about 8 kHz, so that signals up to 4 kHz may be transmitted as is also shown in FIGS. 4*a* and 4*b*. As another example, if the bandwidth should be extended up to 6 kHz the sampling frequency may be increased to around 12 kHz.

In step 52, the bandwidth limited envelope is determined. In step 53, the extended envelope is determined by utilizing, for example, the bandwidth limited envelope and the codebook approach. For determining the excitation signal, the envelope is removed from the speech signal in step 54. In the next step 55, the extended excitation signal is generated, and is combined in step 56 with the extended envelope in order to generate an enhanced speech signal.

Figure 6:
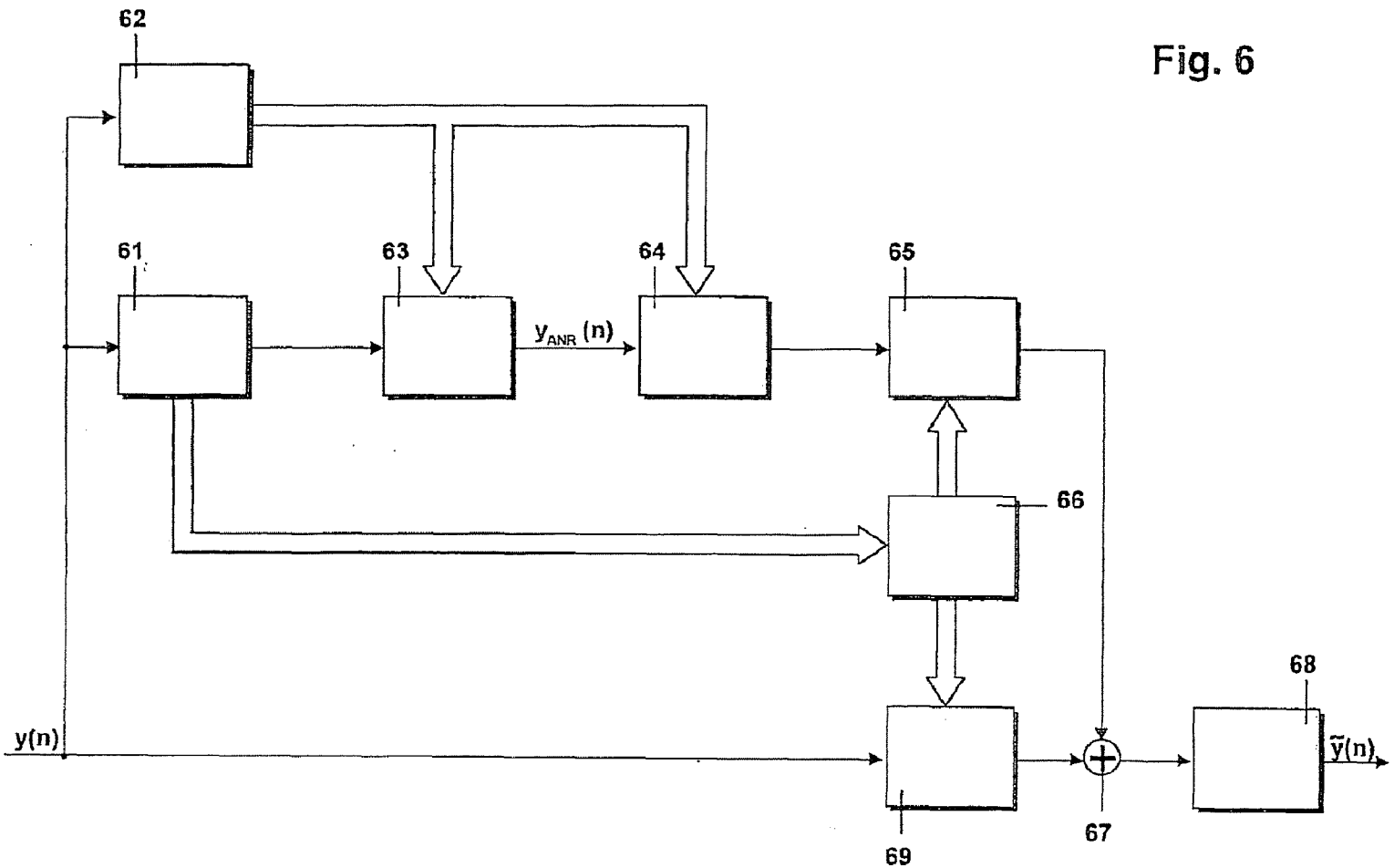
FIG. 6 is a schematic view of an example of a system for reconstructing noisy parts of a speech signal recorded in a noisy environment according to implementations of the invention.

In FIG. 6 the lower part of the system of FIG. 2 is shown in more detail. As was already discussed in connection with FIG. 2, the recorded speech signal y(n) is recorded in a noisy environment, so that the recorded signal y(n) includes speech components and noise components. In order to improve the speech quality, noise reduction methods may be employed. These noise reduction methods work fairly well if the signal to noise ratio is not too bad. In the case of speech signals strongly influenced by noise, however, most noise reduction methods also deteriorate the recorded speech signal. As will be discussed in connection with FIGS. 6 to 8, the noisy parts of the spectrum of the speech signal are replaced by a signal in which the noisy parts are replaced by an extrapolated signal.

At the beginning, the recorded speech signal y(n) is investigated and the parts of the signal are determined that include speech, however in which the components are dominated by the noise components. In the example illustrated in FIG. 6, this can be done by a noise dominant part determining unit 61. As shown in FIG. 7*a* the parts 71 of the signal are determined in which the recorded signal 72 is strongly influenced by the noise, so that the speech signal 73 cannot be correctly identified any more, as the speech signal 73 is lower than the noise signal 74.

As indicated in FIG. 7*b*, the spectral envelope of the voice signal is determined. In FIG. 7*b*, graph 75 depicts the estimated envelope of the speech signal that is not influenced by the noise, and graph 76 indicates the envelope of the recorded speech signal that includes noise components. The spectral envelope may be determined, for example, by employing a linear predictive coding analysis as described above.

For comparing the coefficients to the coefficients stored in the codebook, the parts of the speech signal where the noise dominates the speech signal (parts 71 of FIG. 7*a*) are not taken into account. This means that a bandwidth limited signal is used for determining the envelope. Using the codebook pairs, the broadband corresponding envelope may be determined. The determination of the broadband envelope may be done in a broadband envelope determining unit 62 of FIG. 6.

The output signal of the noise dominant part determining unit 61 is input to an excitation signal extracting unit 63, in which the excitation signal $Y_{ANR}(n)$ is extracted from the speech signal. This may be done by multiplying the speech signal, which may be a noise-reduced speech signal, with the inverse of the spectral envelope that was determined before. As a result of this whitening of the signal, the bandwidth limited excitation signal is obtained as can be seen by signal 77 of FIG. 7*c*. In the excitation signal 77, the frequency parts of the noisy parts 71 of the signal are omitted. These parts need to be replaced by a newly generated signal. This signal will be obtained as will be discussed in detail later on. Once the bandwidth extended excitation signal 78 of FIG. 7*c* is obtained, the bandwidth extended excitation signal 78 may be multiplied with the extended envelope 75. As a result, the enhanced speech signal 79 is obtained that is, as can be seen in FIG. 7*d*, quite close to the original speech signal 73. The enhanced speech signal 79 corresponds more precisely to the original speech signal 73 than the recorded noisy speech signal 72. The resulting enhanced speech signal 79 can be obtained by using the original speech signal in the non-replaced parts or by using a noise-reduced signal, where in the noisy part 71 the recorded speech signal is replaced by the extended parts of the excitation signal multiplied with the extended envelope calculated before.

Coming back to FIG. 6, the bandwidth of the excitation signal is extended at the excitation signal extracting unit 63. The broadband envelope is applied to the bandwidth extended excitation signal at a signal mixing unit 64. An upper frequency-selective filter 65 and a lower frequency-selective filter 69 are controlled by a control unit 66. The control unit 66 determines which part of the spectrum of the original signal is utilized for the enhanced speech signal by controlling the lower frequency-selective filter 69 indicated in FIG. 6. Moreover, the control unit 66 controls the upper frequency-selective filter 65 of FIG. 6 in such a way that the noisy parts in which the noise dominates the speech signal cannot pass the lower frequency-selective filter 69. The noisy parts are replaced by the newly generated signal. These newly generated parts pass the upper frequency-selective filter 65 and are combined with the original speech signal at an adder 67. When the extended speech signal includes higher frequency components, a conversion of the sampling frequency is necessary and may be done in a converting unit 68.

Figure 7:
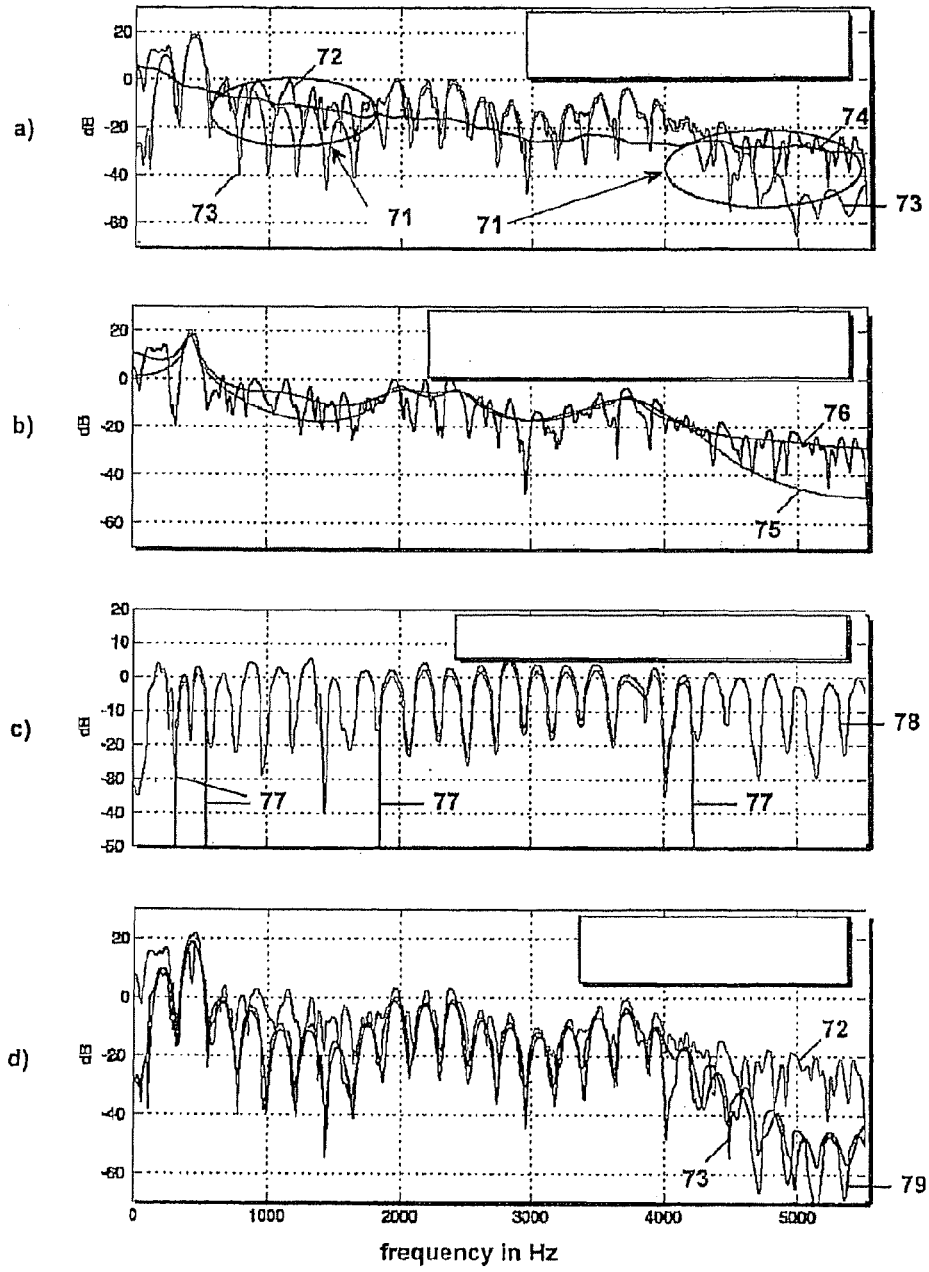
FIG. 7 is a set of graphs illustrating different graphs of the recorded speech signal and the enhanced speech signal according to implementations of the invention.
Figure 8:
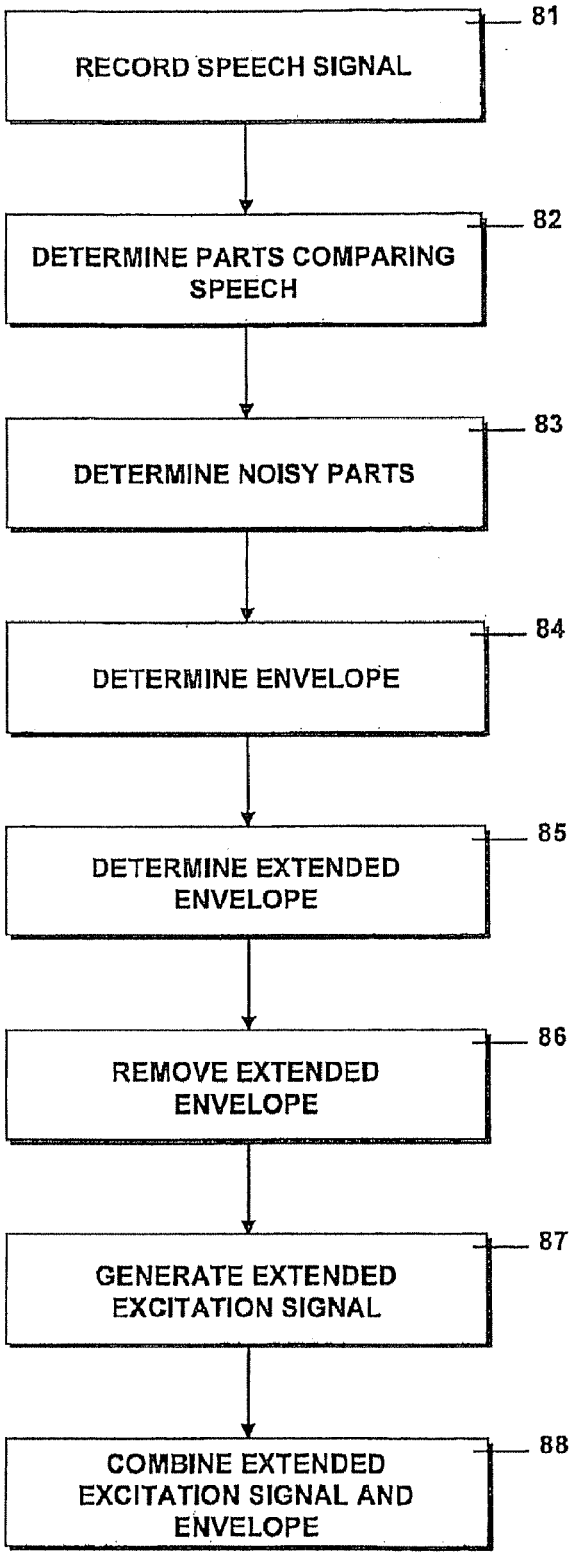
FIG. 8 is a flowchart illustrating an example of a method for replacing the noisy parts of a recorded speech signal according to implementations of the invention.

FIG. 8 is a flow diagram illustrating an example of a method for reconstructing noisy parts of a speech signal recorded in a noisy environment. First of all, the speech signal is recorded in step 81. Within the recorded speech signal, the parts of the speech signal need to be determined in which speech is present (step 82). Within these parts, the parts of the signal are determined in which the noise signal dominates the speech signal, as can be shown by graphs 73 and 72 (step 83). Additionally, the envelope is determined in step 84 based on the bandwidth limited speech signal, in which the noisy parts of the speech signal are suppressed. Once the bandwidth limited envelope is determined, the bandwidth extended envelope can be determined in step 85 by utilizing, for example, the corresponding codebook pair. The extended envelope is then removed from the speech signal (step 86), so that the excitation signal is obtained. In step 87 the extended excitation signal is generated by extending the bandwidth of the bandwidth limited excitation signal (signal 77 of FIG. 7*c*). Lastly, the extended excitation signal is combined with the extended envelope in order to generate the enhanced speech signal (step 88).

When comparing FIGS. 5 and 8 or when comparing FIGS. 4 and 7 it can be seen that the method for reconstructing noisy parts of a speech signal recorded in a noisy environment and the method for extending the spectral bandwidth of a speech signal transmitted via a bandwidth limited transmission system utilize a common approach. The common steps used in both cases are mainly the generation of the spectral envelope on the basis of the bandwidth limited speech signal. The next main step that is common to both approaches is the generation of the extended excitation signal on the basis of the bandwidth limited excitation signal.

As was discussed above, an excitation signal having a larger bandwidth than the bandwidth limited excitation signal needs to be generated. In the following, the generation of the extended excitation signal is discussed in detail.

The basic idea of bandwidth extension algorithms is to extract information on the missing components from the available narrowband signal. For finding information that is suitable for this task most of the algorithms employ the so-called source-filter model of speech generation. This model is motivated by the anatomical analysis of the human speech apparatus. A flow of air coming from the lungs is pressed through the vocal cords. At this point two scenarios can be distinguished. In a first scenario the vocal cords are loose causing a turbulent nose-like air flow. In a second scenario the vocal cords are tense and closed. The pressure of the air coming from the lungs increases until it causes the vocal cords to open. Now the pressure decreases rapidly and the vocal cords close once again. This scenario results in a periodic signal. The signal observed directly behind the vocal cords is called an excitation signal.

This excitation signal has the property of being spectrally flat. After passing the vocal cords the air flow travels through several cavities of the human mouth. In all these cavities the air flow undergoes frequency dependent reflections and resonances depending on the geometry of the cavity. The source-filter model tries to rebuild these two scenarios that are responsible for the generation of the excitation signal by using two different signal generators: a noise generator for rebuilding unvoiced (noise-like) utterances and a pulse train generator for rebuilding voiced (periodic) utterances.

By applying a nonlinear quadratic function to the bandwidth limited excitation signal, an example of which is described below, the bandwidth of the excitation signal may be increased, and an extended excitation signal may be generated. The extended excitation signal can be utilized to generate an extended speech signal. The extended speech signal may include frequency components that have either been suppressed by a transmission line such as a telecommunication line or the extended signal parts can replace parts of a speech signal recorded in a noisy environment, the recorded speech signal including noisy components in which the background noise is the dominant factor.

As noted above, the basic idea of the bandwidth extension algorithm is to extract information on the missing components from the available narrowband signals x(n) and y(n). One way for expanding the bandwidth of the signal is the application of nonlinear characteristics to periodic signals. By applying a nonlinear characteristic to such a periodic speech signal, harmonics are produced that may be used for increasing the bandwidth. The task of bandwidth extension may be mainly divided into two subtasks, namely the generation of a broadband excitation signal and the estimation of the broadband spectral envelope. The broadband spectral envelope may be obtained, for example, by using the codebook approach as mentioned above. The other task may be solved by, for example, applying a nonlinear characteristic, in the present case a special quadratic characteristic.

For calculating the extended excitation, the signal is divided into several segments, and the calculation is done for each segment of the signal.

By way of example, the signal may be represented by the following vector:

$$x_p(n)=[x_{p,0}(n), x_{p,1}(n), \ldots, x_{p,N-1}(n)]^T. \quad \text{(I)}$$

The parameter N designates the length of the segment, $x_p$ indicating that the signal is the spectrally flat signal.

In the following, the newly defined quadratic nonlinear function may be utilized for extending the bandwidth:

$$\tilde{x}_{Anr,i}(n)=c_2(n)x^2_{p,i}(n)+c_1(n)x_{p,i}(n) \quad \text{(II)}$$

The two coefficients $c_1$ and $c_2$ are defined as follows.

$$c_1(n) = K_1 - x_{max}(n)c_2(n) = K_1 - x_{max}\left(\frac{K_1 - K_2}{x_{max}(n) - x_{min}(n) + \varepsilon}\right) \quad \text{(III)}$$

$$c_2(n) = \frac{K_1 - K_2}{x_{max}(n) - x_{min}(n) + \varepsilon}. \quad \text{(IV)}$$

The terms $x_{max}(n)$ and $x_{min}(n)$ represent the maximum and the minimum of the input vector $x_p$.

$$x_{max}(n)=\max\{x_{p,0}(n), x_{p,1}(n), \ldots x_{p,N-1}(n)\}, \quad \text{(V)}$$

$$x_{min}(n)=\min\{x_{p,0}(n), x_{p,1}(n), \ldots x_{p,N-1}(n)\}. \quad \text{(VI)}$$

The term $\epsilon$ is a positive number in order to avoid a division by zero, and this positive number may be small. The two constants $K_1$ and $-K_2$ are the maximum value and the minimum value, respectively, after applying the above equation II to the speech signal. The following values of $K_1$ and $K_2$ have been found as being suitable for the present case: $K_1$=1.2 and $K_2$=0.2. It should be understood, however, that the present invention is not limited to these two values. It is also possible to use any other values for $K_1$ and $K_2$. Generally, the following values have been found as being particularly useful for the above-mentioned excitation signal: $K_1$ may be a value in the range from 0.5 to 1.7. In another example, $K_1$ may be a value in the range from 1.0 to 1.5. In yet another example, $K_1$ is 1.2. $K_2$ may be a value in the range from 0.0 to 0.5. In another example, $K_2$ may be a value in the range from 0.1 to 0.3. In yet another example, $K_2$ is 0.2.

Figure 10:
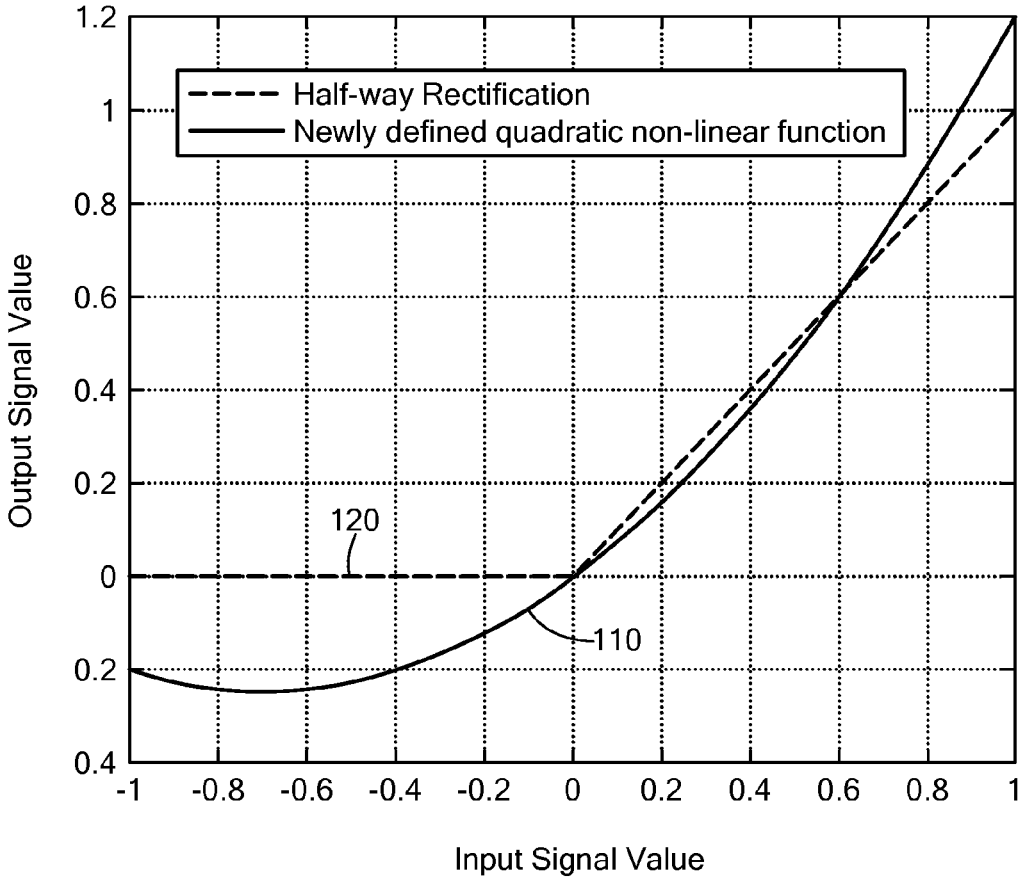
FIG. 10 is a graph illustrating a nonlinear function that may be utilized for extending the spectral bandwidth of an excitation signal according to implementations of the invention.

In FIG. 10, the nonlinear quadratic function as applied to the bandwidth limited excitation signal to generate the bandwidth extended excitation signal is shown by graph 110. Additionally, the graph of a halfwave rectifier 120 is also shown for comparison.

As can be seen from equations III and IV, the coefficients $c_1$ and $c_2$ also depend on n, i.e. on the time. Due to this, it is possible to put more weight either on the linear factor or on the quadratic factor of equation II depending on the input signal, i.e. the speech signal.

The enhanced speech signals that were generated based on a quadratic bandwidth extension scheme as mentioned above were investigated by listening tests. The tests have shown that when the above-defined quadratic function is utilized, the speech quality may be considerably improved. Tests have shown that, when the bandwidth of the excitation signal is extended by utilizing the above-defined function, the speech signal sounds more natural and the speech quality in general is increased as well. By way of example the enhanced speech quality can be shown using comparison mean opinion score (CMOS) tests.

Figure 9:
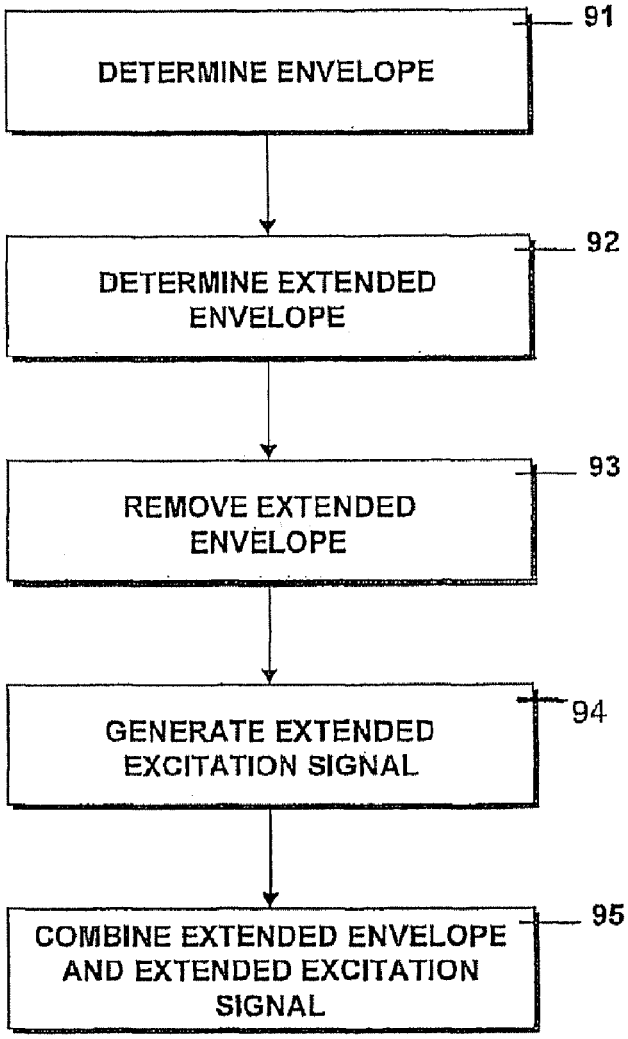
FIG. 9 is a flowchart illustrating an example of methods of the invention in which common steps are utilized for a bandwidth extension of a bandwidth limited telephone signal and for reconstructing noisy parts of a speech signal recorded in a noisy environment according to implementations of the invention.

When the steps carried out during the method for reconstructing noisy parts of the speech signal are compared to the methods for the bandwidth extension of a speech signal transmitted via a telecommunication line, it follows that the same steps are utilized. In FIG. 9, the common steps employed in both approaches are shown. When FIGS. 4 and 7 are compared, it can be seen that the first common step is to determine a bandwidth limited envelope based on a bandwidth limited speech signal (step 91). Based on the envelope determined in step 91, the extended envelope is determined in step 92 (the envelopes 44 and 75 in FIGS. 4 and 7, respectively). In the next step 93, the extended envelope is removed from the speech signal to generate the excitation signal. In the next step 94, the extended excitation signal is generated by applying, for example, the above-defined quadratic function to the bandwidth limited excitation signal. Finally, the extended envelope is combined with the extended excitation signal to generate the enhanced speech signal (step 94).

When the bandwidth is extended for the bandwidth limited speech signal of the telephone signal (upper branch of FIG. 2), the missing frequency components are known in advance (the components from 0 to 200 Hz and the components above 3500 Hz). On the other hand, in the lower branch of FIG. 2, when the noisy parts of a speech signal recorded in a noisy environment are reconstructed, the frequency components that need to be replaced are not known at the beginning and thus to be determined for each signal component. Nevertheless, the same steps are carried out as shown in FIG. 9. Coming back to FIG. 2, this means that the signal reconstruction unit 24 carries out the steps that are common to both approaches, and which are shown in FIG. 9. By way of example and as shown in FIG. 2, the coefficients $c_x(n)$ of the linear predictive coding analysis are extracted by the bandwidth extension unit 20 and transmitted to the signal reconstruction unit 24, and the coefficients of the broadband envelope c $\tilde{x}$ (n) are returned to the bandwidth extension unit 20. In the same way, the coefficients $c_y(n)$ are transmitted to the signal reconstruction unit 24, and the coefficients of the broadband envelope c $\tilde{y}$ (n) are fed back to the speech recognition unit 25, as a common codebook may be used in the signal reconstruction unit 24.

Summarizing, the present invention provides a joint scheme for restoring a signal in a certain frequency part, either the heavily distorted frequency part of the recorded speech signal or the frequency part not transmitted via the transmission medium. Additionally, the restored frequency parts are extracted from the residual frequency range. By means of the joint scheme, the speech quality can be considerably enhanced, especially in those scenarios where traditional methods such as noise suppression systems do not work properly.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A method for extending the spectral bandwidth of an excitation signal of a speech signal, comprising:

determining a bandwidth limited excitation signal of the speech signal; and generating a bandwidth extended excitation signal based on the bandwidth limited excitation signal by applying a quadratic function to the bandwidth limited excitation signal where the quadratic function is:

$$\tilde{x}_{Anr,i}(n)=c_2(n)x^2_{p,i}(n)+c_1(n)x_{p,i}(n),$$

where $c_1$ and $c_2$ are determined according to the following relations:

$$c_1(n) = K_1 - x_{max}(n)c_2(n) = K_1 - x_{max}\left(\frac{K_1 - K_2}{x_{max}(n) - x_{min}(n) + \varepsilon}\right), \text{ and}$$

$$c_2(n) = \frac{K_1 - K_2}{x_{max}(n) - x_{min}(n) + \varepsilon}, \text{ where}$$

$x_{max}$=Maximum value of input signal vector $x_p$,
$x_{min}$=Minimum value of input signal vector $x_p$,
$\epsilon>0$,
n=time,
$K_1$=Constant for determining maximum value after applying quadratic function to speech signal,
$K_2$=Constant for determining minimum value after applying quadratic function to speech signal,
i =segment of signal, and
$x_{p,i}(n)$=Portion of i of spectrally flat excitation signal at time n.

2. The method of claim 1, where $x_{max}$ and $x_{min}$ are determined according to the following relations:

$$x_{max}(n)=\max\{x_{p,0}(n), x_{p,1}(n), \ldots x_{p,N-1}(n)\},$$

$$x_{min}(n)=\min\{x_{p,0}(n), x_{p,1}(n), \ldots, x_{p,N-1}(n)\},$$

$K_1$=1.2, and
$K_2$=0.2.

3. The method of claim 1, further including determining a bandwidth limited spectral envelope of the speech signal, and removing the bandwidth limited spectral envelope from the speech signal by applying an inverse spectral envelope to the speech signal.

4. The method of claim 3, where determining the bandwidth limited spectral envelope of the speech signal includes utilizing a linear predictive coding analysis.

5. The method of claim 3, where removing the spectral envelope from the speech signal includes multiplying the inverse spectral envelope with the speech signal in the frequency domain of the speech signal.

6. The method of claim 3, where removing the spectral envelope from the speech signal includes convolving the inverse spectral envelope with the speech signal in the time domain of the speech signal.

7. The method of claim 1, further including dividing the speech signal into overlapping segments, each segment being described by the following vector, with the spectral envelope of the speech signal being removed: $x_p(n)=[x_{p,0}(n), x_{p,1}(n), \ldots, x_{p,N-1}(n)]^T$ where N=length of the segment.

8. The method of claim 1, further including high pass filtering the extended excitation signal for removing frequency components around 0 Hz.

9. The method of claim 1, further including utilizing extended parts of the excitation signal for replacing noisy parts of the bandwidth limited excitation signal, the bandwidth limited excitation signal corresponding to a speech signal recorded in a noisy environment.

10. The method of claim 1, further including utilizing extended parts of the excitation signal for replacing the corresponding parts of a bandwidth limited excitation signal corresponding to a bandwidth limited speech signal transmitted via a transmission unit of a telecommunication system, the spectral parts of the speech signal suppressed by the transmission line being generated on the basis of the extended spectral bandwidth parts of the excitation signal.

11. A method for enhancing the quality of a speech signal, comprising:

determining a spectral envelope of the speech signal based on the speech signal having a limited spectral bandwidth;

generating a bandwidth limited excitation signal of the speech signal;

extending the spectral bandwidth of the generated excitation signal by applying a quadratic function to the bandwidth limited excitation signal; and applying the bandwidth extended excitation signal to the spectral envelope for generating the enhanced speech signal where the quadratic function is:

$$\tilde{x}_{Anr,i}(n)=c_2(n)x^2_{p,i}(n)+c_1(n)x_{p,i}(n),$$

where $c_1$ and $c_2$ are determined according to the following relations:

$$c_1(n) = K_1 - x_{max}(n)c_2(n) = K_1 - x_{max}\left(\frac{K_1 - K_2}{x_{max}(n) - x_{min}(n) + \varepsilon}\right), \text{ and}$$

$$c_2(n) = \frac{K_1 - K_2}{x_{max}(n) - x_{min}(n) + \varepsilon}, \text{ where}$$

$x_{max}$=Maximum value of input signal vector $x_p$,
$x_{min}$=Minimum value of input signal vector $x_p$,
$\epsilon>0$,
n=time,
$K_1$=Constant for determining maximum value after applying quadratic function to speech signal,
$K_2$=Constant for determining minimum value after applying quadratic function to speech signal,
i=segment of signal, and
$x_{p,i}(n)$ =Portion of i of spectrally flat excitation signal at time n.

12. The method of claim 11, where the speech signal is one transmitted by a bandwidth limited transmission system, and generating the enhanced speech signal extends the spectral bandwidth of the speech signal and causes signal reconstruction of noisy parts of the speech signal recorded in a noisy environment.

13. The method of claim 11, including removing the determined spectral envelope from the bandwidth limited speech signal for generating the bandwidth limited excitation signal.

14. The method of claim 11, including multiplying the extended excitation signal with the spectral envelope in the frequency domain of the speech signal for generating the enhanced speech signal.

15. The method of claim 11, including increasing the sampling frequency before determining the spectral envelope.

16. The method of claim 11, where the speech signal is a signal transmitted via a transmission unit of a telecommunication system, the spectral parts of the speech signal suppressed by the transmission unit being added by the spectral bandwidth extension.

17. The method of claim 16, where the frequency components suppressed by the transmission unit of the telecommunication system are the frequency components of the speech signal between 0 and approximately 200 Hz and frequency components larger than approximately 3700 Hz.

18. The method of claim 11 where, for extending the spectral bandwidth, the spectral envelope is determined on the basis of the bandwidth limited speech signal transmitted by a bandwidth limited transmission system, a bandwidth extended spectral envelope is determined by comparing the bandwidth limited spectral envelope to predetermined envelopes stored in a look up table and by selecting the envelope in the look up table that best matches the bandwidth limited spectral envelope of the voice signal, and the extended spectral envelope being applied to the extended excitation signal for generating the enhanced bandwidth extended speech signal.

19. The method of claim 11, including reconstructing noisy parts of a speech signal by replacing the noisy parts of the speech signal on the basis of the extended parts of the bandwidth extended excitation signal for generating an enhanced speech signal.

20. A system for extending the spectral bandwidth of the speech signal transmitted by a bandwidth limited transmission system and for signal reconstruction for noisy parts of the speech signal recorded in a noisy environment, the system comprising:

a determination unit for determining a spectral envelope based upon a bandwidth limited part of the speech signal;

a generating unit for generating an bandwidth limited excitation signal;

a calculation unit for calculating a bandwidth extended excitation signal by applying a quadratic function to the bandwidth limited excitation signal and for applying the spectral envelope to the bandwidth extended excitation signal for generating an enhanced speech signal where the quadratic function is:

$$\tilde{x}_{Anr,i}(n)=c_2(n)x^2_{p,i}(n)+c_1(n)x_{p,i}(n),$$

where $c_1$ and $c_2$ are determined according to the following relations:

$$c_1(n) = K_1 - x_{max}(n)c_2(n) = K_1 - x_{max}\left(\frac{K_1 - K_2}{x_{max}(n) - x_{min}(n) + \varepsilon}\right), \text{ and}$$

$$c_2(n) = \frac{K_1 - K_2}{x_{max}(n) - x_{min}(n) + \varepsilon}, \text{ where}$$

$x_{max}$=Maximum value of input signal vector $x_p$, $x_{min}$=Minimum value of input signal vector $x_p$, $\epsilon>0$, n=time, $K_1$=Constant for determining maximum value after applying quadratic function to speech signal, $K_2$=Constant for determining minimum value after applying quadratic function to speech signal, i =segment of signal, and $x_{p,i}(n)$ =Portion of i of spectrally flat excitation signal at time n.

* * * * *